US005939972A

United States Patent [19]

Nagao et al.

[11] Patent Number: 5,939,972

[45] Date of Patent: Aug. 17, 1999

[54] POSITIVE TEMPERATURE CHARACTERISTIC THERMISTOR AND THERMISTOR ELEMENT

[75] Inventors: Yoshitaka Nagao; Toshiharu Hirota; Yasuhiro Nabika, all of Shiga, Japan

[73] Assignee: Murata Manufacturing Co., Ltd., Kyoto, Japan

[21] Appl. No.: 08/857,097

[22] Filed: May 15, 1997

[30] Foreign Application Priority Data

May 20, 1996 [JP] Japan ..... 8-124731
Dec. 18, 1996 [JP] Japan ..... 8-338573

[51] Int. Cl.[6] ..... H01C 7/10

[52] U.S. Cl. ..... 338/22 R

[58] Field of Search ..... 338/22 R, 225 D, 338/322, 324, 328; 219/441

[56] References Cited

U.S. PATENT DOCUMENTS

| | | | |
|---|---|---|---|
| 3,798,415 | 3/1974 | Graham et al. | 219/441 |
| 4,330,703 | 5/1982 | Horsma et al. | 219/553 |
| 4,590,489 | 5/1986 | Tsumura et al. | 346/76 |
| 4,720,624 | 1/1988 | Kikuchi et al. | 219/553 |
| 5,267,005 | 11/1993 | Yamamoto et al. | 355/290 |
| 5,557,251 | 9/1996 | Takaoka | 338/22 R |

FOREIGN PATENT DOCUMENTS

| | | |
|---|---|---|
| 93/00688 | 1/1993 | European Pat. Off. . |
| 06302405 | 10/1994 | Japan . |
| 08045707 | 2/1996 | Japan . |

*Primary Examiner*—Teresa Walberg
*Assistant Examiner*—Jeffrey Pwu
*Attorney, Agent, or Firm*—Majestic, Parsons, Siebert & Hsue P.C.

[57] ABSTRACT

A thermistor element with positive temperature characteristic (PTC) has a planar ceramic member with a positive temperature characteristic of which the thickness is greater at its peripheral part than at the center part, decreasing either gradually or in a stepwise manner. Protrusions may be formed along its periphery. A PTC thermistor is formed with electrodes formed on both main surfaces of such a PTC thermistor, each electrode having a lower-layer electrode all over a main surface and an upper-layer electrode on the lower-layer electrode. The upper-layer electrode has a smaller surface area than the lower-layer electrode such that a portion of the lower-surface electrode is exposed at the periphery. The upper-layer electrodes may be formed at the center parts of the main surfaces, exclusive of the peripheral parts or where the protrusions are formed. The lower-layer electrodes may be mostly of Ni and the upper-layer electrodes mainly of Ag.

13 Claims, 3 Drawing Sheets

POSITIVE TEMPERATURE CHARACTERISTIC THERMISTOR AND THERMISTOR ELEMENT

BACKGROUND OF THE INVENTION

This invention relates to positive temperature characteristic (PTC) thermistor elements and PTC thermistors, and more particularly to such thermistor elements and thermistors which have a large flash resistance voltage and are adapted for use in circuits for protection against overcurrent, demagnetization current or motor start-up.

As shown in FIG. 13, a conventional PTC thermistor 121 may be described as having ohmic electrodes 123 and 124 formed on the two main surfaces of a planar thermistor element 122. When a voltage is applied to such a thermistor, the rush current is large at the very beginning because the thermistor 121 has a low resistance, causing it to heat up quickly and splitting it into layers across a plane approximately parallel to its main surfaces. The voltage immediately before such a laminar splitting takes place, when a rush current passes through a PTC thermistor, is called its flash resistance voltage. The flash resistance voltage tends to become small if the PTC thermistor is made smaller.

SUMMARY OF THE INVENTION

It is therefore an object of this invention to provide PTC thermistor elements and PTC thermistors having a large flash resistance voltage.

PTC thermistor elements according to this invention, with which the above and other objects can be accomplished, may be briefly characterized as being thinner at its center than at the peripheral parts of its main surfaces. More in detail, PTC thermistor elements of this invention comprises a planar ceramic member with a positive temperature characteristic, having main surfaces with a peripheral part which surrounds a center part, and the thickness of this ceramic member is greater at the peripheral part than at the center part. As an example, such a PTC thermistor element may be formed with protrusions provided along its periphery, surrounding the center part which is thinner. Alternatively, the thickness of the ceramic member may decrease gradually from the peripheral part towards the center part. As still another example, the thickness may decrease in a stepwise manner from the peripheral part to the center part.

PTC thermistors according to this invention may be characterized as having electrodes formed on the main surfaces of a PTC thermistor element as described above. Each electrode is composed of a lower-layer electrode all over a main surface and an upper-layer electrode on the lower-layer electrode. The upper-layer electrode has a smaller surface area than the lower-layer electrode such that a portion of the lower-surface electrode is exposed at the periphery. The upper-layer electrodes may be formed at the center parts of the main surfaces, exclusive of the peripheral parts and where the protrusions are formed. The lower-layer electrodes may be mostly of Ni and the upper-layer electrodes mainly of Ag.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
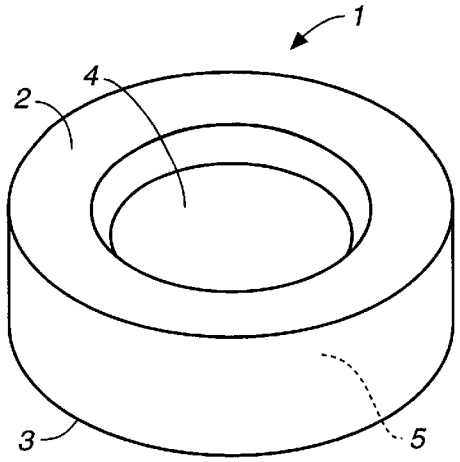
FIG. 1 is a diagonal view of a PTC thermistor element according to a first embodiment of the invention.

FIG. 1 shows a PTC thermistor element 1 according to a first embodiment of this invention, produced by molding and sintering a ceramic material of an approximately planar shape, each of its main surfaces being provided with a protrusion 2 or 3 all along its periphery and an indentation 4 or 5 at the center. A PTC thermistor can be obtained from such an element by forming electrodes on both main surfaces of such a PTC thermistor element 1 of which the main component is ohmic In—Ga, Al or Ag.

Figure 2:
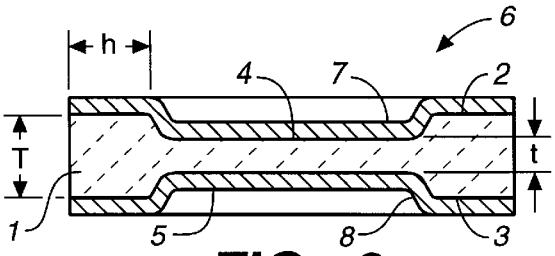
FIG. 2 is a sectional view of a PTC thermistor of Test Example 1 of this invention.

PTC thermistors 6 of Test Example 1 shown in FIG. 2 according to this invention were produced approximately in the shape of a circular disk with outer diameter ϕ8.2 mm, thickness T at the protrusion 4 mm, width h of the protrusion in the radial direction 1 mm and thickness t at the indentation 3 mm with electrodes 7 and 8 of In—Ga formed on both their main surfaces. Table 1 shows the measured values of flash resistance voltage of these PTC thermistors 6. The Curie temperature of these thermistors 6 was 120° C. and their resistance at normal temperature was 23Ω.

Figure 13:
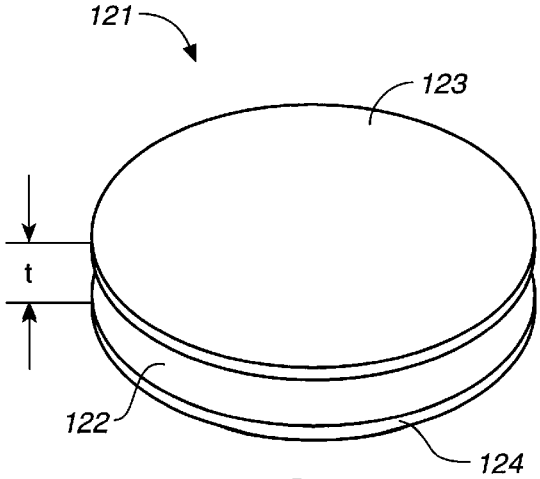
FIG. 13 (PRIOR ART)
FIG. 13 is a diagonal view of a conventional PTC thermistor.

As Comparison Example 1, PTC thermistor elements in the shape of a circular disk as shown at 122 in FIG. 13 were prepared with outer diameter ϕ8.2 mm and uniform thickness t 3 mm and PTC thermistors 121 were obtained by forming electrodes 123 and 124 of In—Ga on their main surfaces, similar to those of Test Example 1. The measured values of flash resistance voltage of these PTC thermistors 121 are also shown in Table 1. The Curie temperature and the resistance at normal temperature of these PTC thermistors 121 were the same as those of PTC thermistors of Test Example 1.

TABLE 1

| | Flash Resistance Voltage (V) | |
|---|---|---|
| | Minimum | Average |
| Test Example 1 | 710 | Over 780 |
| Comparison Example 1 | 355 | 510 |

Table 1 clearly shows that the minimum flash resistance voltage in Test Example 1 is about twice that of Comparison Example 1, indicating a remarkable improvement. The average for Test Example 1 was given only as "over 780" because the maximum voltage that could be applied by the test instrument which was used for the measurement was 810V and there were thermistors which did not break at 810V.

Figure 3:
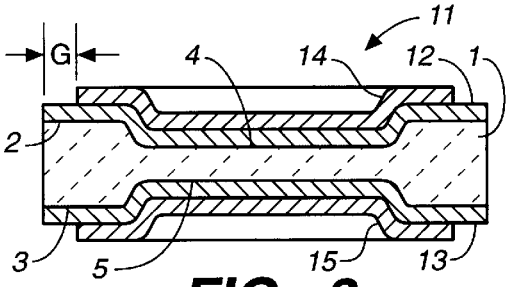
FIG. 3 is a sectional view of a PTC thermistor of Test Example 2 of this invention.

As Test Example 2, PTC thermistor elements 1, the same as those used in Test Example 1, were prepared, lower-layer electrodes 12 and 13 made of Ni were formed on both their main surfaces, and upper-layer electrodes 14 and 15 made of Ag were formed respectively on the lower-layer electrodes 12 and 13, as shown in FIG. 3, to obtain PTC thermistors 11. The gap G between the peripheries of the lower-layer electrodes 12 and 13 and the upper-layer electrodes 14 and 15 was 0.5 mm. Table 2 shows the measured values of flash resistance voltage of these PTC thermistors 11. The Curie temperature of these thermistors 11 was 120° C. and their resistance at normal temperature was 23Ω.

As Comparison Example 2, the same PTC thermistor elements 122, as used in Comparison Example 1, were prepared and PTC thermistors were obtained therefrom by forming, as for Test Example 2, lower-layer electrodes of Ni and upper-layer electrodes of Ag on both their main surfaces with a gap G of 0.5 mm along the periphery of the upper-layer electrodes. The measured values of flash resistance voltage of these PTC thermistors are also shown in Table 2. The Curie temperature and the resistance at normal temperature of these PTC thermistors were the same as those of PTC thermistors of Test Example 2.

TABLE 2

| | Flash Resistance Voltage (V) | |
|---|---|---|
| | Minimum | Average |
| Test Example 2 | 710 | Over 800 |
| Comparison Example 2 | 355 | 535 |

Table 2 clearly shows that the minimum flash resistance voltage in Test Example 2 is about twice that of Comparison Example 2, indicating a remarkable improvement. The average for Test Example 2 was given only by a minimum value for the same reason given with reference to Table 1.

Figure 4:
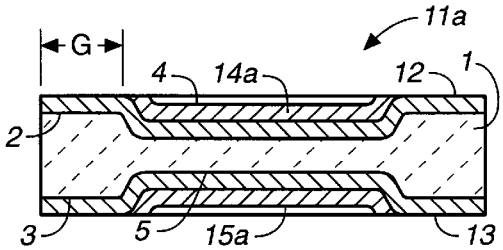
FIG. 4 is a sectional view of a PTC thermistor of Test Example 3 of this invention.

As Test Example 3, PTC thermistor elements 1, the same as those used in Test Example 1, were prepared, lower-layer electrodes 12 and 13 made of Ni were formed on both their main surfaces, and upper-layer electrodes 14*a* and 15*a* made of Ag were formed respectively on the lower-layer electrodes 12 and 13, as shown in FIG. 4, to obtain PTC thermistors 11*a*. The gap G between the peripheries of the lower-layer electrodes 12 and 13 and the upper-layer electrodes 14*a* and 15*a* was 1.0 mm, and the upper-layer electrodes 14*a* and 15*a* were formed only inside the indentations 4 and 5 of the PTC thermistor element 1. Table 3 shows the measured values of flash resistance voltage of these PTC thermistors 11*a*. The Curie temperature of these thermistors 11*a* was 120° C. and their resistance at normal temperature was 23Ω.

As Comparison Example 3, the same PTC thermistor elements 122, as used in Comparison Example 1, were prepared and PTC thermistors were obtained therefrom by forming, as for Test Example 2, lower-layer electrodes of Ni and upper-layer electrodes of Ag on both their main surfaces with a gap G of 1.0 mm along the periphery of the upper-layer electrodes. The measured values of flash resistance voltage of these PTC thermistors are also shown in Table 3. The Curie temperature and the resistance at normal temperature of these PTC thermistors were the same as those of PTC thermistors of Test Example 3.

TABLE 3

| | Flash Resistance Voltage (V) | |
|---|---|---|
| | Minimum | Average |
| Test Example 3 | 710 | Over 785 |
| Comparison Example 3 | 355 | 535 |

Table 3 clearly shows that the minimum flash resistance voltage in Test Example 3 is about twice that of Comparison Example 3, indicating a remarkable improvement. The average for Test Example 3 was given only by a minimum value for the same reason given above with reference to Table 1.

Figure 5:
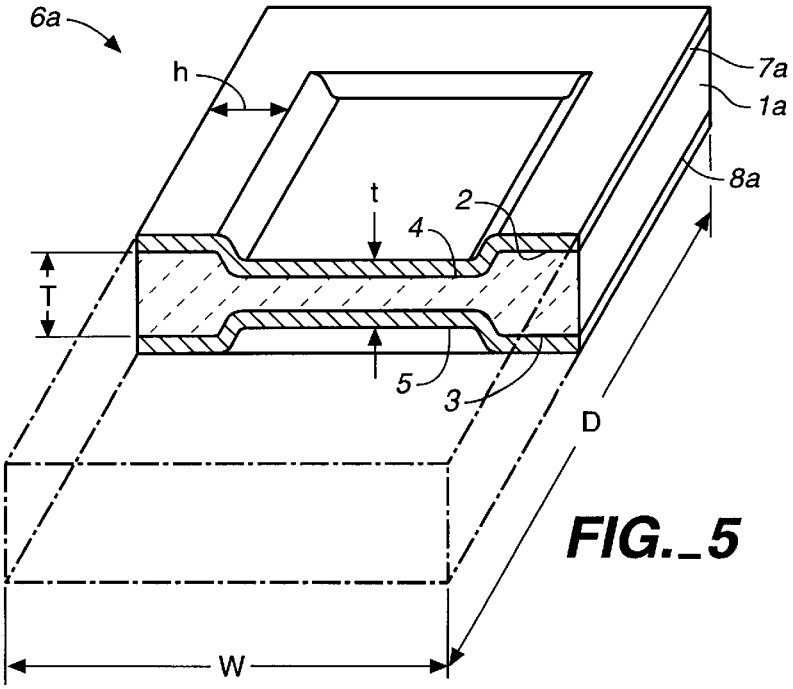
FIG. 5 is a sectional view of a PTC thermistor of Test Example 4 of this invention.

As Test Example 4, approximately rectangular planar PTC thermistor elements 1*a* with width W=6 mm, length D=8 mm, thickness at protrusions T=4 mm, width of protrusions h=1 mm and thickness between the two main surfaces t=3 mm were prepared, and electrodes 7*a* and 8*a* of In—Ga were formed on both their main surfaces as shown in FIG. 5, to obtain PTC thermistors 6*a*. Table 4 shows the measured values of flash resistance voltage of these PTC thermistors 6*a*. The Curie temperature of these thermistors 6*a* was 120° C. and their resistance at normal temperature was 20Ω.

As Comparison Example 4, rectangular planar PTC thermistor elements with width W=6 mm, length D=8 mm and uniform thickness t=3 mm were prepared, and electrodes made of In—Ga were formed on both their main surfaces as for Test Example 4. The measured values of flash resistance voltage of these PTC thermistors are also shown in Table 4. The Curie temperature and the resistance at normal temperature of these PTC thermistors were the same as those of PTC thermistors of Test Example 4.

TABLE 4

| | Flash Resistance Voltage (V) | |
|---|---|---|
| | Minimum | Average |
| Test Example 4 | 630 | Over 720 |
| Comparison Example 4 | 315 | 460 |

Table 4 clearly shows that the minimum flash resistance voltage in Test Example 4 is twice that of Comparison Example 4, indicating a remarkable improvement. The average for Test Example 4 was given only by a minimum value for the same reason given above with reference to Table 1.

Figure 6:
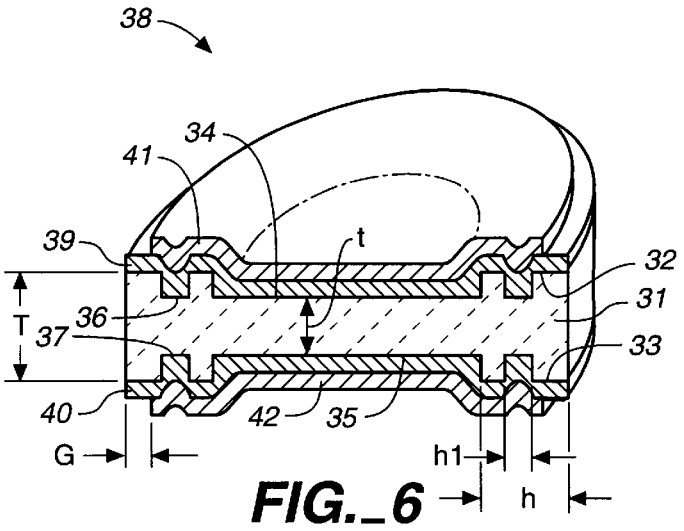
FIG. 6 is a partially sectional diagonal view of a PTC thermistor obtained by forming electrodes on a PTC thermistor element according to a second embodiment of the invention.

FIG. 6 will be referenced next to describe a PTC thermistor element 31 according to a second embodiment of this invention.

The PTC thermistor element 31 according to this embodiment of the invention is obtained by molding and sintering a ceramic material for PTC thermistors, approximately in the shape of a circular disk having protrusions 32 and 33 formed completely around the periphery of both its main surfaces and indentations 34 and 35 formed inside and surrounded by these protrusions 32 and 33. Grooves 36 and 37 are provided in the direction of the thickness T of this ceramic material at the positions of these protrusions 32 and 33.

A PTC thermistor 38 is obtained from this PTC thermistor element 31 by forming lower-layer electrodes 39 and 40 on its both main surfaces and upper-layer electrodes 41 and 42 thereover with a gap G such that their peripheral parts will be exposed all around the circumference, as shown in FIG. 3.

Figure 7:
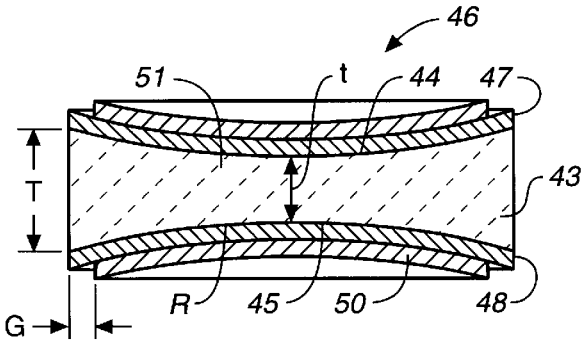
FIG. 7 is a sectional view of a PTC thermistor obtained by forming electrodes on a PTC thermistor element according to a third embodiment of the invention.

FIG. 7 will be referenced next to describe a PTC thermistor element 43 according to a third embodiment of the invention.

The PTC thermistor element 43 according to this embodiment of the invention is obtained by molding and sintering a ceramic material for PTC thermistors, approximately in the shape of a circular disk with thickness decreasing gradually from the peripheral parts towards the center such that indentations 44 and 45 are formed at the center parts of its both main surfaces.

A PTC thermistor 46 is obtained from this PTC thermistor element 43 by forming lower-layer electrodes 47 and 48 on its both main surfaces and upper-layer electrodes 49 and 50 thereover with a gap G such that their peripheral parts will be exposed all around the circumference, as shown in FIG. 3.

Figure 8:
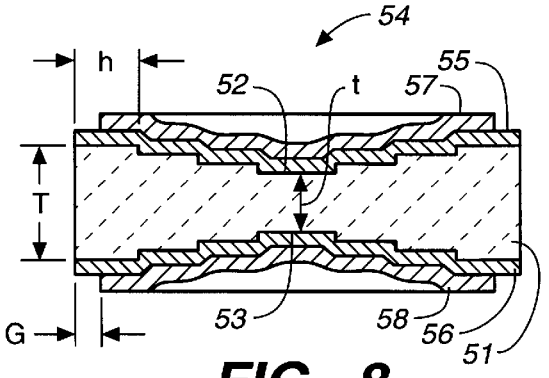
FIG. 8 is a sectional view of a PTC thermistor obtained by forming electrodes on a PTC thermistor element according to a fourth embodiment of the invention.

FIG. 8 will be referenced next to describe a PTC thermistor element 51 according to a fourth embodiment of the invention.

The PTC thermistor element 51 according to this embodiment of the invention is obtained by molding and sintering a ceramic material for PTC thermistors, approximately in the shape of a circular disk with thickness decreasing from the peripheral parts towards the center in a stepwise manner such that indentations 52 and 53 are formed at the center parts of its both main surfaces.

A PTC thermistor 54 is obtained from this PTC thermistor element 51 by forming lower-layer electrodes 55 and 56 on its both main surfaces and upper-layer electrodes 57 and 58 thereover with a gap G such that their peripheral parts will be exposed all around the circumference, as shown in FIG. 3.

Figure 9:
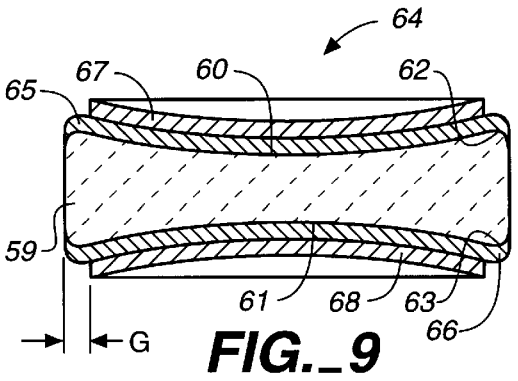
FIG. 9 is a sectional view of a PTC thermistor obtained by forming electrodes on a PTC thermistor element according to a fifth embodiment of the invention.

FIG. 9 will be referenced next to describe a PTC thermistor element 59 according to a fifth embodiment of the invention.

The PTC thermistor element 59 according to this embodiment of the invention is obtained by molding and sintering a ceramic material for PTC thermistors, approximately in the shape of a circular disk with thickness gradually decreasing from the peripheral parts towards the center manner such that indentations 60 and 61 are formed at the center parts of its both main surfaces and the peripheral edges 62 and 63 where the main surfaces join the peripheral side surface are rounded.

A PTC thermistor 64 is obtained from this PTC thermistor element 59 by forming lower-layer electrodes 65 and 66 on its both main surfaces and upper-layer electrodes 67 and 68 thereover with a gap G such that their peripheral parts will be exposed all around the circumference, as shown in FIG. 3. Alternatively, only one of the peripheral edges 62 and 63 may be rounded.

Figure 10:
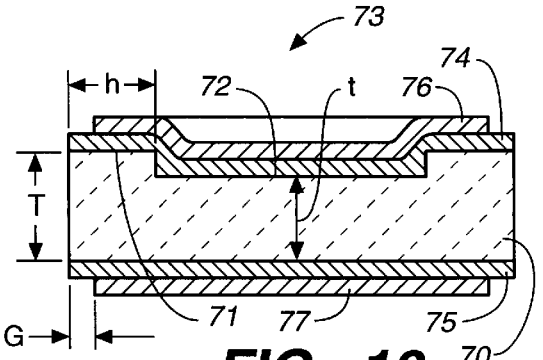
FIG. 10 is a sectional view of a PTC thermistor obtained by forming electrodes on a PTC thermistor element according to a sixth embodiment of the invention.

FIG. 10 will be referenced next to describe a PTC thermistor element 70 according to a sixth embodiment of the invention.

The PTC thermistor element 70 according to this embodiment of the invention is obtained by molding and sintering a ceramic material for PTC thermistors, approximately in the shape of a circular disk with a protrusion 71 formed all around the periphery on one of the main surfaces and an indentation 72 at the center of this main surface surrounded by this protrusion 71.

A PTC thermistor 73 is obtained from this PTC thermistor element 70 by forming lower-layer electrodes 74 and 75 on its both main surfaces and upper-layer electrodes 76 and 77 thereover with a gap G such that their peripheral parts will be exposed all around the circumference, as shown in FIG. 3.

It may be noted that the PTC thermistor element according to the sixth embodiment is different from the PTC thermistor 1 according to the first embodiment in that an indentation is formed only on one of its main surfaces to make its thickness T along its periphery larger than at the center. Similarly, the PTC thermistor elements according to the second through fifth embodiments of the invention may be modified such that the thinner center area and thicker peripheral area can be formed by the shape of only one of the main surfaces.

As Test Example 5, PTC thermistor elements 31 as shown in FIG. 6 were prepared, with outer diameter ϕ8.2 mm, thickness around the periphery T=4 mm, width of protrusions h=1.2 mm, width of the groove h1=0.4 mm and thickness at the indentation t=3 mm. Ni layers as lower-layer electrodes 39 and 40 and Ag layers as upper-layer electrodes 41 and 42 were formed with a gap G=0.2 mm on both their main surfaces to obtain PTC thermistors 38. Table 5 shows the measured values of flash resistance voltage of these PTC thermistors 38.

As Test Example 6, PTC thermistor elements 43 as shown in FIG. 7 were prepared, with outer diameter ϕ8.2 mm, thickness around the periphery T=4 mm, cross-sectional shape of the protruded part being an arc with radius R=17.06 mm, and thickness at the indentation t=3 mm. Ni layers as lower-layer electrodes 47 and 48 and Ag layers as upper-layer electrodes 49 and 50 were formed with a gap G=0.2 mm on both their main surfaces to obtain PTC thermistors 46. Table 5 also shows the measured values of flash resistance voltage of these PTC thermistors 46.

As Test Example 7, PTC thermistor elements 51 as shown in FIG. 8 were prepared, with outer diameter ϕ8.4 mm, thickness around the periphery T=4 mm, width of each step of the stepwise protrusion h=1.2 mm, the height of each step being 0.16 mm, and thickness at the indentation t=3.04 mm. Ni layers as lower-layer electrodes 55 and 56 and Ag layers as upper-layer electrodes 57 and 58 were formed with a gap G=0.2 mm on both their main surfaces to obtain PTC thermistors 54. Table 5 also shows the measured values of flash resistance voltage of these PTC thermistors 54.

As Test Example 8, PTC thermistor elements 59 were prepared by rounding off the edges of PTC thermistor elements of Test Example 6 to radius R=1 mm. Ni layers as lower-layer electrodes 65 and 66 and Ag layers as upper-layer electrodes 67 and 68 were formed with a gap G=0.2 mm on both their main surfaces to obtain PTC thermistors 64 as shown in FIG. 9. Table 5 also shows the measured values of flash resistance voltage of these PTC thermistors 64.

As Test Example 9, PTC thermistor elements 70 as shown in FIG. 10 were prepared with outer diameter ϕ8.2 mm, thickness around the periphery T=3.5 mm, width of protrusions h=1 mm, and thickness at the indentation t=3 mm. Ni layers as lower-layer electrodes 74 and 75 and Ag layers as upper-layer electrodes 76 and 77 were formed with a gap G=0.2 mm on both their main surfaces to obtain PTC thermistors 73. Table 5 also shows the measured values of flash resistance voltage of these PTC thermistors 64.

The Curie temperature of all these PTC thermistors of Test Examples 5–9 was 120° C. and their resistance at normal temperature was 22Ω. For each of Test Examples, eighteen sample PTC thermistors were tested.

As Comparison Example 5, PTC thermistor elements in the shape of a circular disk as shown in FIG. 13 were prepared with outer diameter ϕ8.2 mm and uniform thickness t=3 mm, and PTC thermistors were obtained by forming lower-layer electrodes of Ni and upper-electrodes of Ag on both their main surfaces as done with Test Example 10 with a gap G=0.2 mm. The measured values of flash resistance voltage of these PTC thermistors are also shown in Table 5. The Curie temperature and the resistance at normal temperature of these PTC thermistors were the same as those of PTC thermistors of Test Example 5.

TABLE 5

| | Flash Resistance Voltage (V) | | |
|---|---|---|---|
| | Minimum | Average | Shape |
| Test Example 5 | 630 | Over 740 | FIG. 6 |
| Test Example 6 | 710 | Over 800 | FIG. 7 |
| Test Example 7 | 630 | Over 760 | FIG. 8 |
| Test Example 8 | 710 | Over 800 | FIG. 9 |
| Test Example 9 | 560 | Over 680 | FIG. 10 |
| Comparison Example 5 | 355 | 510 | FIG. 13 |

As can be understood by comparing Comparison Example 5 in Table 5, PTC thermistors according to this invention of Test Examples 5–9 with indentations at the center of the main surfaces have a significantly improved flash resistance voltage. The averages for Test Examples 5–9 were given only by minimum values for the same reason given above with reference to Table 1.

As Test Examples 10–14, PTC thermistor elements with the shapes as for Test Examples 5–9 but made of a different material were prepared and lower-layer and upper-layer electrodes were formed as above to obtain PTC thermistors with Curie temperature of 70° C. and resistance at normal temperature of 9Ω.

Figure 11:
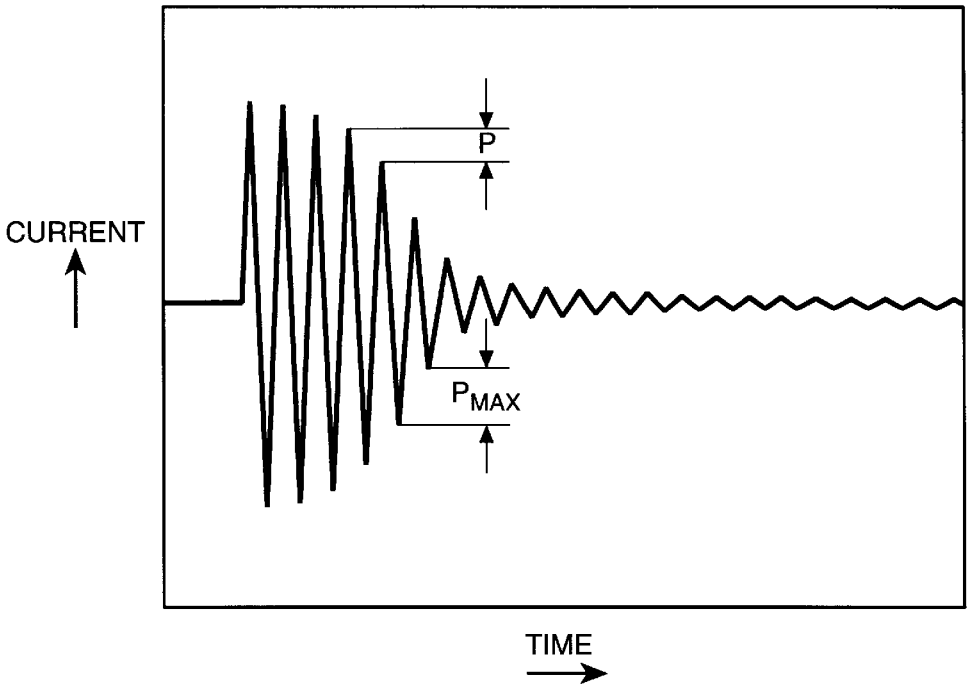
FIG. 11 shows an alternate attenuating current through an demagnetization coil in a demagnetization circuit.

When a current is passed through a demagnetization circuit using a PTC and an alternating attenuating current as shown in FIG. 11 flows through the demagnetization coil, the difference between the heights of its mutually adjacent peaks is called the envelop differential P. Let $P_{max}$ represent its maximum value, as shown in FIG. 11. For the eighteen PTC thermistors each of Test Examples 10–14, flash resistance voltage and $P_{max}$ were measured and their volumes were calculated. The results are shown in Table 6.

Figure 12:
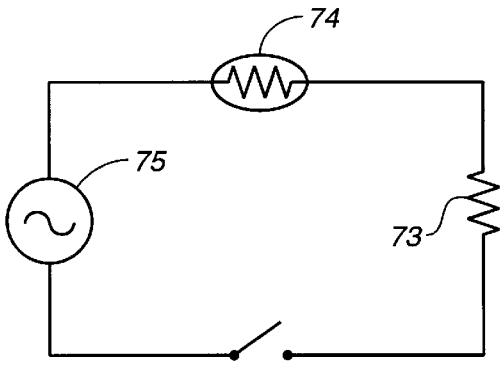
FIG. 12 is diagram of a circuit for measuring $P_{max}$, defined below.

As Comparison Example 5, PTC thermistor elements in the shape of a circular disk as shown in FIG. 13 were prepared with outer diameter ϕ8.2 mm and uniform thickness t=3 mm, and PTC thermistors were obtained by forming lower-layer electrodes of Ni and upper-electrodes of Ag on both their main surfaces as done with Test Example 10 with a gap G=0.2 mm. Results of similar measurements made on these PTC thermistors are also shown in Table 6. The Curie temperature and the resistance at normal temperature of these PTC thermistors were the same as those of PTC thermistors of Test Example 10. In these tests, the value of $P_{max}$ was obtained as shown in FIG. 12 by using a resistor 73 of resistance 20Ω instead of a demagnetization coil and applying an AC voltage 75 of 200V and 60 Hz to a series connection of this resistor 73 with a PTC thermistor 74.

TABLE 6

| | Flash Resistance Voltage (V) | | | Volume | |
|---|---|---|---|---|---|
| | min. | Ave. | $P_{max}$ | ($cm^3$) | Shape |
| Test Example 10 | 450 | 560 | 3.9 | 0.1760 | FIG. 6 |
| Test Example 11 | 400 | 560 | 3.7 | 0.2024 | FIG. 7 |
| Test Example 12 | 355 | 560 | 3.8 | 0.1920 | FIG. 8 |
| Test Example 13 | 450 | 560 | 3.7 | 0.2014 | FIG. 9 |
| Test Example 14 | 400 | 560 | 3.9 | 0.1697 | FIG. 10 |
| Comparison Example 15 | 280 | 355 | 4.3 | 0.2112 | FIG. 13 |

As can be understood by comparing Comparison Example 15 in Table 6, PTC thermistors according to this invention of Test Examples 10–14 with indentations at the center of the main surfaces have significantly improved flash resistance voltages and smaller $P_{max}$ values. This means that the volume of a PTC thermistor can be made smaller compared to Comparison Example 15.

Although the invention has been described above with reference to only a limited number of examples, these examples are not intended to limit the scope of the invention. Many modifications and variations are possible within the scope of this invention. For example, their external shape need not be circular or rectangular. Instead of the single grooves 36 and 37 shown in FIG. 6, more than one such groove may be formed on one of both of the main surfaces. Rounded edges as shown on the PTC thermistor 59 in FIG. 9 may be provided to other PTC thermistors with any shape.

The material for the lower-layer electrodes is not limited to In—Ga and Ni. Any ohmic material such as Al, Cr, Cr alloys and ohmic Ag may be used. The electrodes may be formed by any method such as sputtering, printing, sintering, flame coating and plating. The electrodes may also consist of three or more layers such as a three-layer structure with a lower-layer electrode of Cr, a middle-layer electrode of monel and an upper-layer electrode with Ag as its principal component. In summary, PTC thermistor elements and PTC thermistors according to this invention have an improved flash resistance voltage because of the indentations formed on the main surfaces. The invention also makes it possible to reduce the size of the PTC thermistor and reduce its $P_{max}$ value. Because of the gap between the lower-layer and upper-layer electrodes, furthermore, silver migration can be prevented. Moreover, generation of sparks between the electrodes can be reduced because the distance therebetween is increased due to the indentations on the PTC thermistor element without reducing the specific resistance.

What is claimed is:

1. A thermistor element with positive temperature characteristic (PTC) having a planar ceramic member with a positive temperature characteristic, said ceramic member having main surfaces with a peripheral part surrounding a center part, said ceramic member having thickness which is greater all along said peripheral part than at said center part.

2. The PTC thermistor element of claim 1 wherein said ceramic member has protrusions all along said peripheral part of said main surfaces.

3. The PTC thermistor element of claim 1 having a groove at said peripheral part.

4. The PTC thermistor element of claim 1 wherein said thickness of said ceramic member decreases gradually from said peripheral part to said center part.

5. The PTC thermistor element of claim 2 wherein said thickness of said ceramic member decreases gradually from said peripheral part to said center part.

6. The PTC thermistor element of claim 3 wherein said thickness of said ceramic member decreases gradually from said peripheral part to said center part.

7. The PTC thermistor element of claim 1 wherein said thickness of said ceramic member decreases in a stepwise manner from said peripheral part to said center part.

8. The PTC thermistor element of claim 1 wherein said ceramic member has a rounded edge along said peripheral part.

9. A thermistor with positive temperature characteristic (PTC) comprising:

a PTC thermistor element having a planar ceramic member with a positive temperature characteristic, said ceramic member having main surfaces with a peripheral part surrounding a center part, said ceramic member having thickness which is greater all along said peripheral part than at said center part; and electrodes on said main surfaces.

10. The PTC thermistor of claim 9 wherein said electrodes each comprises a lower-layer electrode all over a corresponding one of said main surfaces and an upper-layer electrode on said lower-layer electrode.

11. The PTC thermistor of claim 10 wherein said upper-layer electrode has a smaller surface area than said lower-layer electrode, a portion of said lower-surface electrode being exposed at said peripheral part.

12. The PTC thermistor of claim 10 wherein said upper-layer electrode is at said center part and exclusive of said peripheral part on each of said main surfaces.

13. The PTC thermistor of claim 10 wherein said lower-layer electrode comprises a metal with Ni as main component thereof and said upper-layer electrode comprises another metal with Ag as main component thereof.

* * * * *